US008616656B2

(12) United States Patent
Klabisch et al.

(10) Patent No.: US 8,616,656 B2
(45) Date of Patent: Dec. 31, 2013

(54) PLOUGHING DEVICE FOR MINING AND PLOUGH BODY FOR SAID DEVICE

(75) Inventors: Adam Klabisch, Dortmund (DE); Norbert Hesse, Bochum (DE); Gerhard Siepenkort, Lunen (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 107 days.

(21) Appl. No.: 13/210,160

(22) Filed: Aug. 15, 2011

(65) Prior Publication Data

US 2012/0038204 A1 Feb. 16, 2012

(30) Foreign Application Priority Data

Aug. 16, 2010 (DE) ..... 20 2010 008 292 U

(51) Int. Cl.
*E21C 27/35* (2006.01)

(52) U.S. Cl.
USPC ..... 299/34.04; 299/43

(58) Field of Classification Search
USPC ..... 299/34.1, 43, 34.01, 34.04
See application file for complete search history.

(56) References Cited

U.S. PATENT DOCUMENTS

| | | | | |
|---|---|---|---|---|
| 4,035,025 | A | 7/1977 | Hermann et al. | |
| 4,189,187 | A | 2/1980 | Rassmann et al. | |
| 4,391,471 | A * | 7/1983 | Hauschopp et al. | 299/43 |
| 4,583,785 | A * | 4/1986 | Breuer et al. | 299/34.09 |
| 4,883,322 | A * | 11/1989 | Blumenthal et al. | 299/34.1 |
| 7,070,040 | B2 | 7/2006 | Klabisch et al. | |
| 7,104,392 | B2 * | 9/2006 | Klabisch et al. | 198/735.1 |
| 7,347,501 | B2 * | 3/2008 | Bettermann et al. | 299/34.09 |
| 8,066,112 | B2 * | 11/2011 | Klabisch et al. | 198/735.1 |

FOREIGN PATENT DOCUMENTS

| | | | |
|---|---|---|---|
| DE | 19637789 | A1 | 3/1998 |
| DE | 102005049971 | A1 | 4/2007 |

* cited by examiner

*Primary Examiner* — David Bagnell
*Assistant Examiner* — Michael Goodwin
(74) *Attorney, Agent, or Firm* — Foley & Lardner LLP

(57) ABSTRACT

A ploughing device for mining, with a ploughing tool having a plurality of plough bodies being interconnected by means of detachable coupling members, and with a longwall conveyor forming a plough guiding means, wherein at least one ploughing body is provided with pivotable cutter carriers. In order to have a ploughing device for mining different seam thicknesses in an efficient manner even and with low number of spare parts to be stored, the ploughing tool has three plough bodies, one forming a central ploughing body, at the end of which are connected a first and second lateral ploughing body by means of a first and second coupling members, wherein the coupling members in each case consist of a toggle bolt with toggle shaft and toggle heads being insertable on open-edged toggle pockets on the bodies.

17 Claims, 2 Drawing Sheets

PLOUGHING DEVICE FOR MINING AND PLOUGH BODY FOR SAID DEVICE

The invention relates to a ploughing device for mining, in particular coal mining, said ploughing device having a ploughing tool that has a plurality of plough bodies that are interconnected by means of detachable coupling members, and having a reversible longwall conveyor which forms a plough guiding means for the individual plough bodies and is constructed from trough elements that are interconnected in a detachable manner by means of trough element connecting means, wherein at least one ploughing body is provided with pivotable cutter carriers for each direction of travel of the ploughing tool and with a moveably mounted connecting rod for a travel-direction-dependent coupling of the pivoting of the cutter carrier. The invention also relates to a ploughing body for the ploughing tool of a ploughing device of this type.

BACKGROUND OF THE INVENTION

In underground mining, in particular coal mining, coal ploughs have been used for many decades for mining underground coal seams. The most used in this connection are individual ploughs, which are restrictedly guided on a plough guiding means attached on the working face side on a longwall conveyor and have a pivotable cutter carrier for each direction of travel and first cutter columns and secondary cutter columns that are mounted on the ploughing body, where applicable, so as to be vertically adjustable in order to be able to adapt the overall height of the individual plough to the respective conditions of use in the underground longwall and above all to the seam thickness. The secondary cutter columns can also be realized as add-on units which can be placed optionally on the ploughing body.

DE 196 37 789 A1, for example, discloses an individual plough which is guided via a guide rail and a track plate on the plough guiding means attached on the working face side on the trough pans of the longwall conveyor and at the same time engages over the conveyor troughs of the longwall conveyor by way of a support portal so that it is additionally supported on a guide rail on the stowage side. The individual plough has a single carriage-shaped ploughing body and the add-on parts with the secondary cutter columns are connected to the ploughing body by means of chain-link-shaped elements.

DE 10 2005 049 971 A1 makes known an individual ploughing body in the form of a sword plough, where pivotable cutter carriers are coupled in a travel-direction-dependent manner by means of a connecting rod so that, in dependence on the direction of travel, always only one of the two cutter carriers removes material at the working face, whilst the other cutter carrier is situated in a pivot position in which the cutters of said cutter carrier have no contact with the working face.

A plough provided with two plough bodies is known, for example, from DE 25 00 680 A1 and from DE 27 28 178 A1. Both plough bodies are restrictedly guided at a plough guiding means attached on the working face side. The two plough bodies are interconnected by means of a joint connection which consists of individual chain links.

SUMMARY OF THE INVENTION

It is an object of the invention to create a ploughing device by way of which different seam thicknesses can be mined in an efficient manner even if different hardness grades exist over the overall height of the coal seam, the store of spare parts for a corresponding ploughing device having to be as low as possible.

These and other objects are achieved according to the invention in that the ploughing tool has three plough bodies of which the ploughing body provided with the connecting rod forms a central ploughing body, at the one end of which a first lateral ploughing body is connected by means of a first coupling member and at the other end of which a second lateral ploughing body is connected by means of a second coupling member, wherein the coupling members in each case consist of a toggle bolt with toggle shaft and two toggle heads and the central ploughing body and the lateral plough bodies have open-edged toggle pockets for holding in each case a toggle head of the toggle bolts.

By the ploughing tool according to the invention being in three parts, it is possible, with the ploughing body moving ahead in each case in the direction of travel, to mine sections at the coal face which lie at a different height to those sections that are mined by way of the pivotable cutter carriers, which reach down as far as the longwall floor or the sill of a seam, on the central ploughing body. The cutter carriers on the central ploughing body, consequently, preferably also have the bottom cutters and by way of said cutters and by way of the cutter carriers, a lower section of the coal face is mined in such a manner that the upper seam layers are undercut so that the lateral ploughing body, running ahead in relation to the central ploughing body at each ploughing run, can in each case remove material already cut at the bottom, i.e. in the vicinity of the sill floor. By using toggle bolts, a connection that is easy to undo and at the same time is particularly solid can be achieved between the central ploughing body and the lateral ploughing body, also ensuring good pivoting mobility between the lateral ploughing body and the central ploughing body, so that the multiple-part ploughing tool, which in a corresponding manner has a large overall length, can be guided on the ploughing tool guiding means even in the case of cavities and depressions and at the same time the cutters, where possible, of only one of the two lateral plough bodies are in engagement with the material to be mined.

It is particularly advantageous if, in the case of the ploughing device, the trough element connecting means also consist of toggle bolts with toggle shaft and two toggle heads. A corresponding toggle with two preferably integrally moulded toggle heads forms a component which is relatively easy to handle and additionally has proved its worth in particular as trough pan connecting means for many years in underground mining for the flexible connection between trough elements. It is especially advantageous when the coupling members for interconnecting the plough bodies and the trough element connecting means are constructed identically to each other and are interchangeable such that, consequently, the same toggle bolt can be used as coupling member for the plough bodies and as connecting means for the trough elements. This has advantages in particular for the provision of spare parts as, in principle, only one element that can be used multifunctionally has to be stocked, namely a suitable toggle bolt.

It is especially advantageous if the toggle heads are integrally moulded on the shaft ends of the toggle shaft. In order to facilitate the mounting and locking of the toggle bolts in the toggle pockets, it is further advantageous when the toggle heads are provided on the head end remote from the toggle shaft with an axially protruding locking tongue that is tapered in cross section in relation to the toggle head. In addition, in each case one of the toggle pockets can preferably be provided with a preferably integrally moulded or welded-on locking shoulder, which one of the locking tongues engages beneath in the fitted state of the toggle bolt, and/or the other toggle pocket is provided with an opening for a multiple-part toggle retaining means for locking the second locking tongue inside the associated toggle pocket. Particularly suitable toggle connections with toggle bolts and toggle pockets as well as multiple-part retaining means are known from DE 203 07 151 U1, reference being made in a supplementary manner to the disclosure content thereof.

In order to be able to adapt the plough bodies to the trough pan present in each case on site and the toggle bolts and toggle connections used there as well as possible, it is particularly advantageous when the toggle pockets consist of components welded on to the respective ploughing body. These measures make it possible for the same plough bodies to be used without any great modifications even on different longwall conveyors with the most varied toggle connections.

In order to be especially variable with regard to the mining of coal seams of different thicknesses, it is especially advantageous when the lateral plough bodies are provided in each case with a pivotable and/or vertically-adjustable first cutter column. It is additionally advantageous when the lateral plough bodies are provided in each case on the side lying remote from the toggle pocket with a secondary cutter column, by way of which material is always only mined at the mining face when the associated lateral ploughing body lies ahead in the direction of travel.

The invention also relates to the individual plough bodies for a multiple-part ploughing tool of a ploughing device described in more detail above, each ploughing body being characterized by at least one toggle pocket for holding the toggle head of a toggle bolt, by way of which a ploughing body is connectable to another ploughing body.

Further advantages and developments of a ploughing device according to the invention are produced from the following description of a ploughing device shown schematically in the drawing.

Further, these and other objects, aspects, features, developments and advantages of the invention of this application will become apparent to those skilled in the art upon a reading of the Detailed Description of Embodiments set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF EMBODIMENTS

Figure 1:
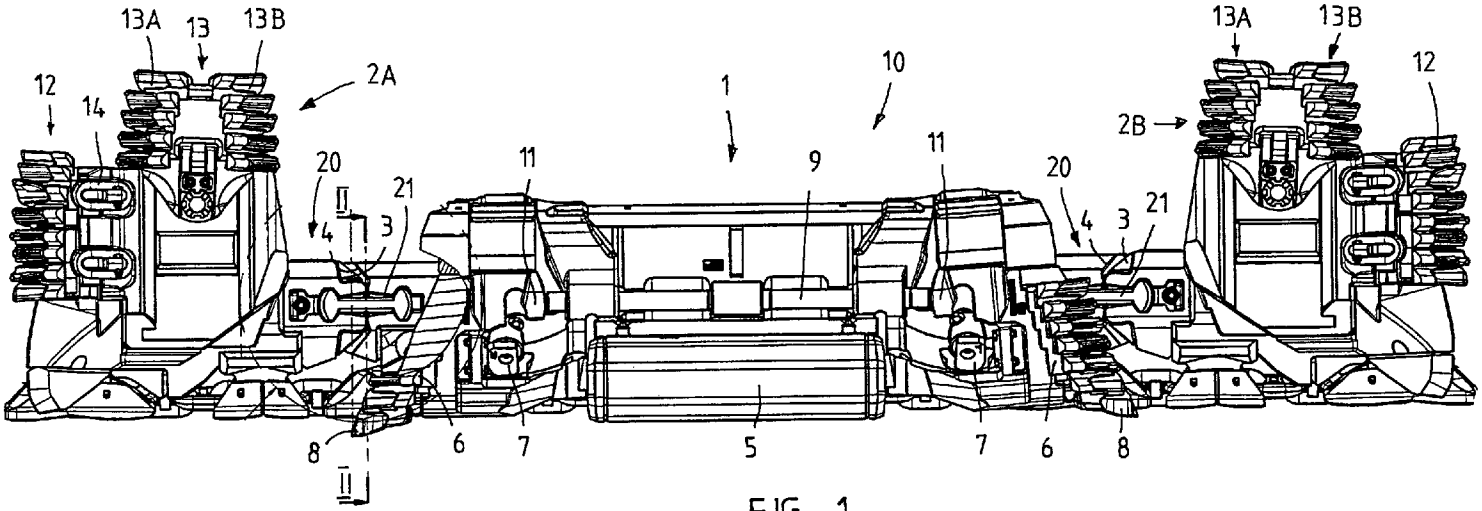
FIG. 1 shows a three-part ploughing tool for a ploughing device according to the invention in a view from the working face side, partially opened up.

Referring now to the drawings wherein the showings are for the purpose of illustrating preferred and alternative embodiments of the invention only and not for the purpose of limiting same, by way of the overall reference 10, FIG. 1 shows an exemplary embodiment of a three-part mining ploughing tool for underground mining in particular for working coal in underground mining. The mining ploughing tool 10 essentially consists of a central ploughing body 1, a first lateral ploughing body 2A and a second lateral ploughing body 2B. The two lateral plough bodies 2A, 2B are constructed identically to each other, albeit in a mirror-inverted manner, and both lateral plough bodies 2A, 2B, on their inner side 3 that in each case lies facing each other, are connected by means of toggle bolts 21 in each case to one of the ends 4 of the central ploughing body 1 so as to be resistant to tensile stress, but angularly moveable in a limited manner, as will be explained again in more detail below.

The central ploughing body 1, with the underside of which the ploughing tool chain (not shown) cooperates via a driving carriage 5, is provided in each case for each direction of travel in the vicinity of its ends 4 with a pivotable cutter carrier 6, which, in a manner that is not represented in detail, in each case is mounted on the central ploughing body 1 so as to be pivotable about a pivot journal 7 and, among other things, is provided with interchangeable bottom cutters 8. The pivoting of the two cutter carriers 6 about each associated pivot journal 7 is coupled in a travel-direction-dependent manner by means of a connecting rod 9, which, here in each case, abuts against a cutter carrier stop member or is fastened flexibly thereto, so that the cutter carrier 6, which is lying ahead in the respective direction of travel of the ploughing tool and is moved downwards by the insertion of its bottom cutter 8 into the rock to be mined, pivots the respective other cutter carrier 6, trailing in the direction of travel of the ploughing tool, upwards; the bottom cutters 8 and milling cutters of said cutter carrier 6 do not then carry out any mining. In FIG. 1, as an example, the bottom cutter 8 of the left-hand cutter carrier 6 is somewhat deeper than the bottom cutter 8 of the right-hand cutter carrier 6, which is why the representation shown corresponds substantially to a ploughing tool run of the mining ploughing tool 10 to the left. As a mining ploughing tool 10 is moved back and forth in an underground longwall along a longwall conveyor 30, illustrated schematically in FIG. 2 by means of a trough pan 31, between the two ends of the longwall, the direction of travel of the ploughing tool and consequently the pivot position of the cutter carriers 6, reverses after each run, as is known in detail to the underground mining expert.

In the case of the three-part mining ploughing tool 10, as shown in FIG. 1, in each case one of the two lateral mining ploughing tools 2A or 2B, once again in dependence on the direction of travel of the ploughing tool, with the direction of travel to the left consequently the left-hand ploughing tool 2A, runs ahead of the central ploughing body 1 and in each case the lateral ploughing tool 2A (or 2B) in front performs the mining work, whilst the other lateral ploughing body 2B is pivoted in such a manner that the cutters connected to the same do not mine any material or at the most mine fractionally. As can be seen easily in FIG. 1, both lateral ploughing tools 2A, 2B are provided on one side with a secondary cutter column 12, by means of which a central lode seam at a working face can be mined, and both lateral plough bodies 2A, 2B also have a first cutter column 13, by way of which an upper lode seam can be mined. The secondary cutter columns 12 are flexibly mounted on the respective lateral ploughing body 2A, 2B so as to be slightly moveable, in this case by means of chain links 14, so that they only perform mining work when the lateral ploughing body 2A, 2B forms the advance ploughing body. The first cutter columns 13, contrary to this, are provided on both sides with rows of cutters 13A, 13B, the one of the two cutter columns 13*a* being able to perform mining work on the upper seam for the one direction of travel of the ploughing tool and the other row of cutters 13B in each case being able to perform mining work on the upper seam for the other direction of travel of the ploughing tool. To this end, the first cutter columns 13 are flexibly mounted on the respective lateral ploughing body 2A, 2B so as to be pivotable and, where applicable, vertically adjustable.

The entire ploughing tool 10 is guided in a sliding manner along the longwall conveyor 30. For this purpose, the trough pans 31 of the longwall conveyor 30, on the working face side, have a ploughing tool guiding means 32 which, as known in mining per se, can include an upper guide strip 33, a lower guide bar 34 partially defining one of the chain channels for the ploughing tool chain and a machine track 35, by means of which the entire mining ploughing tool 10 with its three plough bodies 1, 2A, 2B is forcibly guided on the ploughing tool guiding means 32. The material mined with the mining ploughing tool 10 is transported away in a known manner per se via the conveyor belt 36 of the longwall conveyor 30 by means of, for example, scraper chains (not shown), the loading of the mined material into the longwall conveyor being effected by means of loading ramps at the mining ploughing tool 10.

Figure 2:
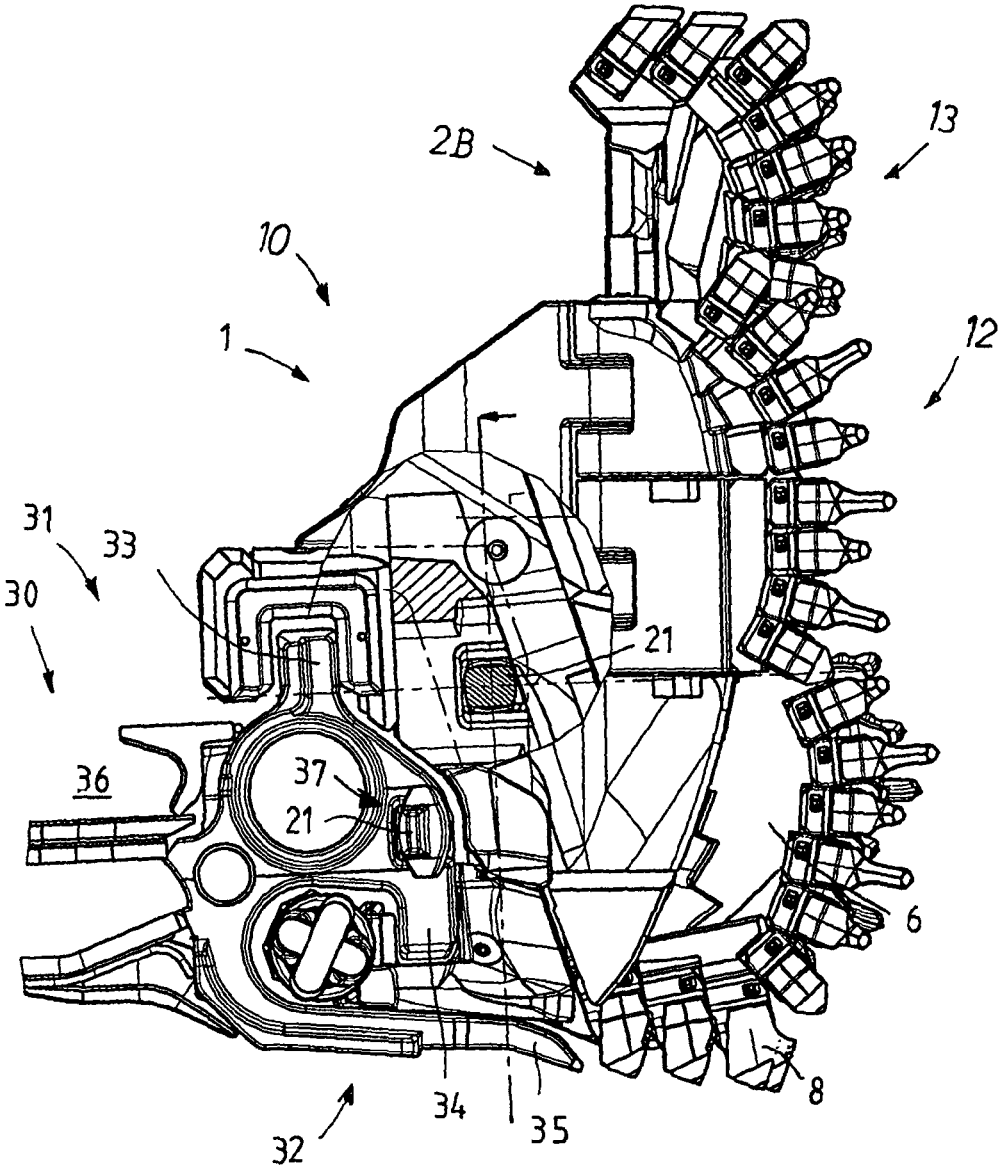
FIG. 2 shows a sectional view along II-II in FIG. 1.

FIG. 2 illustrates that the cutters on the cutter carrier 6, which is assigned to the central ploughing body 1, protrude deeper in the direction of the working face (not shown) at the coal seam to be mined than the individual cutters of the secondary cutter column 12 and of the first cutter column 13. This has particular advantages when mining coal beds or coal seams with a different hardness over the overall height as a lower bed can already be cut away with the cutters arranged on the central ploughing body 1, whilst the material situated above is not cut away, in principle, until the next ploughing tool run.

Figure 5:
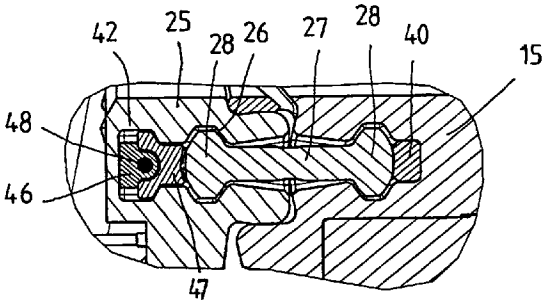
FIG. 5 shows a longitudinal section through the toggle connection in FIG. 3.
Figure 3:
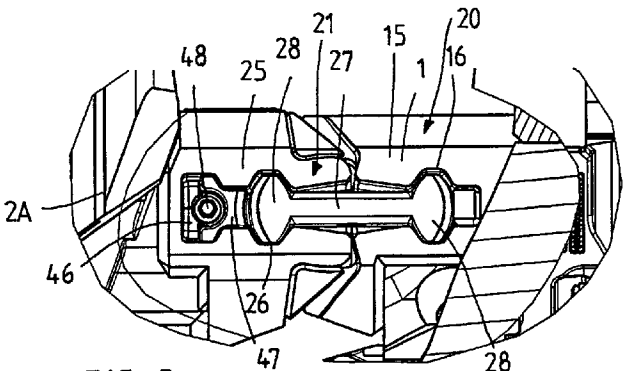
FIG. 3 shows a detailed view of the toggle connection between a lateral ploughing body and the central ploughing body.
Figure 4:
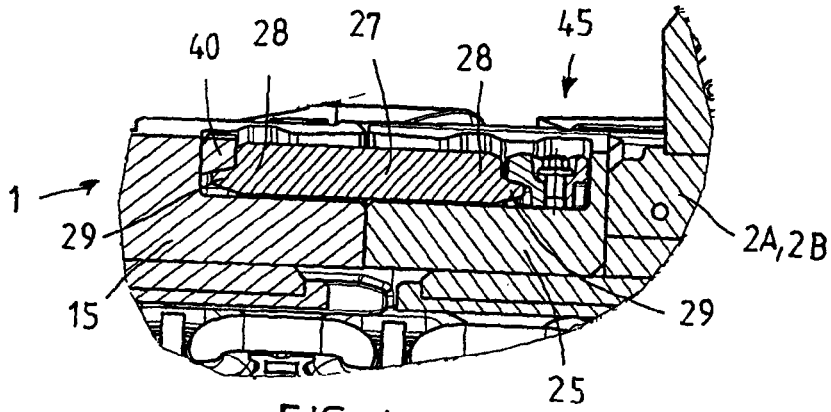
FIG. 4 shows a horizontal section (mirror-inverted) through the toggle connection in FIG. 3.

Another characteristic feature in the case of the ploughing tool 10 according to the invention is that, as already mentioned above, the central ploughing body 1 is connected in each case to one of the lateral plough bodies 2A by means of a toggle connection 20 with a toggle bolt 21 as coupling means. Reference is now made to FIGS. 3 to 5, in which a side view and different sectional views of a toggle connection 20 with toggle bolt 21 is shown in each case in detail. In order to realize the toggle connection 20, the central ploughing body 1 is provided with a total of two toggle pockets 15 and each lateral ploughing body 2A is provided with one toggle pocket 25. All toggle pockets 15, 12 are provided with a toggle holding means 16, 26 so that a toggle bolt 21, which has a toggle shaft 27 with toggle heads 28 integrally moulded in this case at both ends, can be inserted into the two toggle pockets 15, 25 in such a manner that the toggle shaft 27 engages over the joint between the two plough bodies 1, 2A or 1, 2B and the toggle heads 28 provide the inextensible connection between the adjacent plough bodies 1, 2A or 1, 2B. In order to secure the toggle bolt 21 at the same time against falling out of the toggle pockets 15, 25, both toggle heads 28 are provided, in each case on the head end lying remote from the toggle shaft 27, with an integrally moulded locking tongue 29, which has a smaller thickness and width than the toggle heads 28. In the mounted state, one of the two locking tongues 29 engages beneath a locking shoulder 40 welded here in each case to the toggle pocket 15 on the central ploughing body 1, whilst the other locking tongue 29 on the toggle pocket 25 associated with the lateral ploughing body 2A, 2B is fixed in the associated toggle pocket 25 by means of a multiple-part toggle retaining means 45. The toggle retaining means 45 consists, in this case, of a filler piece 46, a locking piece 47 which engages over the locking nose on the toggle bolt 21 in the mounted state, and a fastening screw 48, by way of which filler piece 46 and locking piece 47 are fixed in an opening 42 in the toggle pocket 25, which connects to the head holding means 26 of the toggle pocket 25. A preferred exemplary embodiment of a toggle connection 20 together with toggle 21 as well as toggle retaining means 45 which can be used in this case is disclosed in DE 203 07 151 U1, reference being made in a supplementary manner to the disclosure content thereof.

The use of a toggle connection 20 with a toggle bolt 21 with two toggle heads 28 integrally moulded on a toggle shaft 27 as coupling means for the individual plough bodies 1, 2A, 2B is particularly advantageous when the same toggle 21 or the same toggle connection 20 is also used as trough pan connecting means 37 for connecting adjacent trough elements 31 of the longwall conveyor 30. This is also illustrated in FIG. 2 in which the toggle forming the trough pan connecting means 37 is also marked with the reference 21.

For the expert the preceding description produces numerous modifications which are to fall within the scope of protection of the attached claims. It is obvious that each individual ploughing body could be expanded in its turn so as to have multiple parts. In place of welded-on toggle pockets, screwed-on or integrally cast toggle pockets could also be used. The toggle bolt used in each case can have various forms, dimensions and geometries and even the manner in which the respective toggle bolt is locked in the toggle pocket can vary. The same applies to the arrangement and the design of the individual cutters and cutter columns on the respective ploughing body. The invention is consequently not limited to the exemplary embodiments shown.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A ploughing device for mining, having a ploughing tool that has a plurality of interconnected plough bodies, and having a reversible longwall conveyor which forms a guide for the plurality of plough bodies and is constructed from trough elements that are interconnected in a detachable manner by trough element connectors, wherein at least one of the plurality of plough bodies is provided with at least one pivotable cutter carrier for each direction of travel of the ploughing tool and a moveably mounted connecting rod for a travel-direction-dependent pivotable coupling of the cutter carrier, the plurality of plough bodies including a first plough body, a second plough body and a third plough body, the first plough body provided with the connecting rod and forms a central plough body having a first cutter carrier with first cutters, the second plough body forms a first lateral plough body connected to the first plough body by a first coupling member and the third plough body forms a second lateral plough body connected to the first plough body by a second coupling member, the first lateral plough body and the second lateral plough body each having a first cutter column configured to mine an upper lode seam, and a second cutter column configured to mine a central lode seam from a working face;

wherein the first cutters on the first cutter carrier of the central plough body protrude deeper in a direction configured to engage the working face than cutters of the first cutter column and the second cutter column of each of the first lateral plough body and the second lateral plough body;

wherein the coupling members in each case includes a toggle bolt with a toggle shaft and two toggle heads and the central plough body and the lateral plough bodies have open-edged toggle pockets for holding in each case a toggle head of the toggle bolts.

2. A ploughing device according to claim 1, wherein the trough element connectors includes toggle bolts with toggle shaft and two toggle heads.

3. A ploughing device according to claim 1, wherein the coupling members and the trough element connectors are interchangeable.

4. A ploughing device according to claim 3, wherein the coupling members and the trough element connectors are constructed identically to each other.

5. A ploughing device according to claim 1, wherein the toggle heads are integrally moulded on the shaft ends of the toggle shaft.

6. A ploughing device according to claim 1, wherein the toggle heads are provided on the head end remote from the toggle shaft with an axially protruding locking tongue that is tapered in cross section in relation to the toggle head.

7. A ploughing device according to claim 6, wherein in each case one of the toggle pockets is provided with a locking shoulder, which one of the locking tongues engages beneath in a fitted state of the toggle bolt, and in that the other toggle pocket is provided with an opening for locking the locking tongue.

8. A ploughing device according to claim 7, wherein the locking shoulder is integrally cast or welded-on.

9. A ploughing device according to claim 1, wherein the toggle pockets includes components welded on to the respective plough body.

10. A ploughing device according to claim 1, wherein the first cutter column on the lateral plough bodies are pivotable and/or vertically-adjustable.

11. A ploughing device according to claim 1, wherein the secondary cutter column on the lateral plough bodies are each provided on the side lying remote from the toggle pocket.

12. A ploughing device for mining, comprising:

a central plough body having at least one pivotally mounted first cutter carrier with first cutters disposed on the first cutter carrier, and a moveably mounted connecting rod for a travel-direction-dependent pivotable coupling of the first cutter carrier;

a first lateral plough body coupled to one side of the central plough body by a first coupling member and a second lateral plough body coupled to another side of the central plough body by a second coupling member, the first lateral plough body and the second lateral plough body each having a first cutter column configured to mine an upper lode seam, and a second cutter column configured to mine a central lode seam from a working face;

wherein the first cutters on the first cutter carrier of the central plough body protrude deeper in a direction configured to engage the working face than cutters of the first cutter column and the second cutter column of each of the first lateral plough body and the second lateral plough body;

wherein the first and second coupling members each comprise a toggle bolt with a toggle shaft and two toggle heads and the central plough body and the first lateral plough body and the second lateral plough body each have open-edged toggle pockets for holding in each case a toggle head of the toggle bolts.

13. The ploughing device of claim 12, wherein the second cutter columns are flexibly mounted on the first lateral plough body and the second lateral plough body.

14. The ploughing device according to claim 12, wherein the toggle heads are provided on the head end remote from the toggle shaft with an axially protruding locking tongue that is tapered in cross section in relation to the toggle head, the at least one toggle pocket of the plough body further including toggle pockets that are provided with a locking shoulder which engages the locking tongues when in a fitted state of the toggle bolt.

15. The ploughing device according to claim 14, wherein the locking shoulder is integrally cast or welded-on.

16. The ploughing device according to claim 12, wherein the toggle pockets further include an opening for a multiple-part toggle retaining means for locking a locking tongue.

17. The ploughing device according to claim 12, wherein the toggle pockets include components welded on to the respective plough body.

* * * * *